US007530133B2

(12) United States Patent
Mitts

(10) Patent No.: US 7,530,133 B2
(45) Date of Patent: May 12, 2009

(54) METHOD FOR CONTROLLING A SPIN CYCLE IN A WASHING MACHINE

(75) Inventor: Kurt J Mitts, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 729 days.

(21) Appl. No.: 11/061,702

(22) Filed: Feb. 18, 2005

(65) Prior Publication Data

US 2006/0185095 A1 Aug. 24, 2006

(51) Int. Cl.
*D06F 33/02* (2006.01)

(52) U.S. Cl. ..... 8/159; 68/12.04

(58) Field of Classification Search ..... 8/158, 8/159; 68/12.04
See application file for complete search history.

(56) References Cited

U.S. PATENT DOCUMENTS

| | | | | | |
|---|---|---|---|---|---|
| 3,674,419 | A | | 7/1972 | Tichy | |
| 4,697,293 | A | | 10/1987 | Knoop | 8/158 |
| 4,856,301 | A | | 8/1989 | Broadbent | 68/12 |
| 5,130,624 | A | | 7/1992 | Bashark | 318/280 |
| 5,161,393 | A | * | 11/1992 | Payne et al. | 68/12.04 |
| 5,596,889 | A | | 1/1997 | Guerra et al. | 68/12.02 |
| 5,671,494 | A | | 9/1997 | Civanelli et al. | 8/159 |
| 5,870,905 | A | * | 2/1999 | Imamura et al. | 68/12.04 |
| 5,887,456 | A | * | 3/1999 | Tanigawa et al. | 68/20 |
| 6,029,299 | A | * | 2/2000 | Baek et al. | 8/159 |
| 6,269,666 | B1 | * | 8/2001 | Whah et al. | 68/12.02 |
| 6,282,965 | B1 | * | 9/2001 | French et al. | 73/660 |
| 6,393,872 | B2 | | 5/2002 | Whah et al. | 68/12.02 |
| 7,331,075 | B2 | * | 2/2008 | Lee et al. | 8/159 |
| 2003/0208852 | A1 | * | 11/2003 | Hardaway et al. | 8/158 |
| 2005/0016227 | A1 | * | 1/2005 | Lee | 68/12.04 |

FOREIGN PATENT DOCUMENTS

| | | | |
|---|---|---|---|
| JP | 7-396675 | * | 2/1995 |
| JP | 10-127979 | * | 5/1998 |

* cited by examiner

*Primary Examiner*—Frankie L Stinson
(74) *Attorney, Agent, or Firm*—Clifton Green; Michael D. LaFrenz

(57) ABSTRACT

A method for spinning clothes in an automatic washing machine comprises determining the size of the fabric load in the washing machine and determining a plaster speed based on the size of the fabric load. A motor gradually increases the rotational speed of the drum to the plaster speed while a balance condition monitor monitors the balanced condition of the fabric load. When the rotational speed of the drum reaches the plaster speed and the load is balanced, the motor rapidly increases the rotational speed of the drum from the plaster speed to an extraction speed. If the load becomes imbalanced at the extraction speed, the rotational speed of the drum is rapidly decreased to a redistribution speed less than the plaster speed to redistribute the load.

26 Claims, 6 Drawing Sheets

METHOD FOR CONTROLLING A SPIN CYCLE IN A WASHING MACHINE

BACKGROUND OF THE INVENTION

1. Field of the Invention

The invention relates to a method for controlling a spin cycle, including clothes load distribution and liquid extraction, in an automatic washing machine.

2. Description of the Related Art

Top and front loading horizontal axis washing machines are well known appliances for cleaning clothing and other fabric items, such as sheets, towels, and the like. Typically, the fabric items in the load are subjected to a cleaning cycle comprising a wash cycle, a rinse cycle, and a spin cycle for extracting rinse liquid from the load. During the spin cycle, a basket that holds the load rotates relative to a coaxial, imperforate drum to impart centrifugal forces on the load. The basket rotates at a high extraction speed sufficient to "plaster" the load to the peripheral wall of the basket (the clothes rotate with the basket and do not tumble) and extract liquid from the fabric items. Generally, the faster the rotation speed, the greater the amount of liquid that can be extracted. This process is effective at removing excess liquid from the fabric items to prepare them to be line dried or dried in a clothes dryer.

A common problem associated with spin cycles is uneven distribution of the load, which is commonly referred to as an imbalanced load. When the fabric items are not evenly distributed in the basket while rotating at the extraction speed, the basket vibrates. Small vibrations can be tolerated and dampened through a suspension system operatively coupled to the basket, but large vibrations tend to generate annoying noise and can damage the washing machine. Most washing machines have a balance condition monitor comprising sensors positioned adjacent the basket or utilizing internal indicators, such as motor current or speed, for identifying when the load is imbalanced. If the imbalance in the load as detected by the balance condition monitor exceeds a predetermined limit, then the washing machine attempts to remedy the imbalance by redistributing the load or ceases rotation of the basket for manual redistribution of the load by the user.

To avoid imbalances in the clothes load at the extraction speed, the washing machine can attempt to distribute the fabric items evenly over the peripheral wall of the basket prior to rotating the basket at the extraction speed. While the imbalance condition is a problem for both vertical and horizontal axis washing machines, the problem is more serious for horizontal axis machines because of their much greater extraction speeds and the tendency of the clothes load to locate on one side of the basket because of gravity.

Numerous methods of distributing the clothes load have been developed for horizontal axis washing machines. Oftentimes, a system for detecting load imbalance is employed during the distribution step so that the washing machine can respond if a load imbalance is detected during or after distribution. However, some distribution methods are reactive in that they attempt to distribute the load and check for load imbalance thereafter rather than being proactive by monitoring load imbalance as the load is distributed and taking action to remedy the imbalance once it is detected. Reactive distribution methods can be extremely inefficient, especially if the load is not properly distributed in the initial attempts. Additionally, most distribution methods do not consider the size of the clothes load and are, therefore, unnecessarily long, especially for relatively small clothes loads. All other things being equal, a shorter cycle time is always preferred by the consumer. Thus, it is desirable for a washing machine to efficiently distribute a load according to its size during a spin cycle and redistribute the load if the fabric items in the load become unbalanced during the spin cycle.

SUMMARY OF THE INVENTION

A method for spinning clothes in an automatic washing machine comprising a rotatable drum defining a wash chamber for receiving a fabric load to be cleaned comprises determining the size of the fabric load; determining a plaster speed based on the size of the fabric load; gradually increasing the rotational speed of the drum to the plaster speed; monitoring the balanced condition of the fabric load; and rapidly increasing the rotational speed of the drum from the plaster speed to an extraction speed if the fabric load is balanced.

The method can further comprise reducing the rotational speed of the drum to a redistribution speed in response to an unbalanced fabric load to effect a redistribution of the fabric load. In one embodiment, the reducing the rotational speed of the drum can comprise reducing the rotational speed of the drum from a speed less than or equal to the plaster speed to the redistribution speed. The method can further comprise gradually increasing the rotational speed of the drum from the redistribution speed to the plaster speed after the reducing of the rotational speed to the redistribution speed. The method can further comprise repeating the reducing of the rotational speed of the drum followed by the gradually increasing of the rotational speed of the drum to the plaster speed until the rotational speed of the drum reaches the plaster speed with the fabric load balanced. The method can further comprise holding the rotational speed of the drum at the extraction speed. The method can further comprise reducing the rotational speed of the drum from the extraction speed to a speed less than the plaster speed in response to an unbalanced fabric load to effect a redistribution of the fabric load. The method can further comprise rapidly increasing the rotational speed of the drum again from the plaster speed to the extraction speed if the fabric load is balanced.

In another embodiment, the reducing the rotational speed of the drum can comprise reducing the rotational speed of the drum from the extraction speed to the redistribution speed. The redistribution speed can be less than the plaster speed. The method can further comprise gradually increasing the rotational speed of the drum from the redistribution speed to the plaster speed. The method can further comprise rapidly accelerating the rotational speed of the drum again from the plaster speed to the extraction speed if the fabric load is balanced.

The monitoring of the balanced condition of the fabric load can comprise monitoring the balanced condition while gradually increasing the rotational speed of the drum to the plaster speed.

The monitoring of the balanced condition of the fabric load can comprise monitoring the balanced condition of the fabric load at the extraction speed. The method can further comprise holding the rotational speed of the drum at the extraction speed.

An automatic washing machine according to the invention comprises a rotatable drum defining a wash chamber sized to receive a fabric load; a motor operably coupled to the drum to rotate the drum; a balance condition monitor outputting a balanced condition signal representative of the balanced condition of the fabric load in the drum; a load size detector outputting a load size signal representative of the size of the load in the drum; and a controller operably coupled to the motor, the balance condition monitor, and the load sized detector. The controller determines a plaster speed based on the load size signal and controls the motor to gradually increase the rotational speed of the drum to the plaster speed and then rapidly increase the rotational speed of the drum from the plaster speed to an extraction speed if the balance monitoring signal indicates a balanced fabric load.

The motor can reduce the rotational speed of the drum to a redistribution speed to effect a redistribution of the fabric load if the balance monitoring signal indicates that the fabric load is imbalanced. The motor can reduce the rotational speed of the drum during the gradual increase to the plaster speed. The motor can gradually increase the rotational speed of the drum to the plaster speed after reducing the speed of the drum to the redistribution speed.

The motor can hold the drum at the extraction speed. The motor can reduce the rotational speed of the drum to a redistribution speed below the plaster speed to effect a redistribution of the fabric load if the balance monitoring signal indicates that the fabric load is imbalanced at the extraction speed. The motor can gradually increase the rotational speed of the drum to the plaster speed after reducing the speed of the drum to the redistribution speed. The motor can rapidly increase the rotational speed of the drum again from the plaster speed to the extraction speed if the balance monitoring signal indicates that the fabric load is balanced.

DESCRIPTION OF THE PREFERRED EMBODIMENT

Figure 1A:
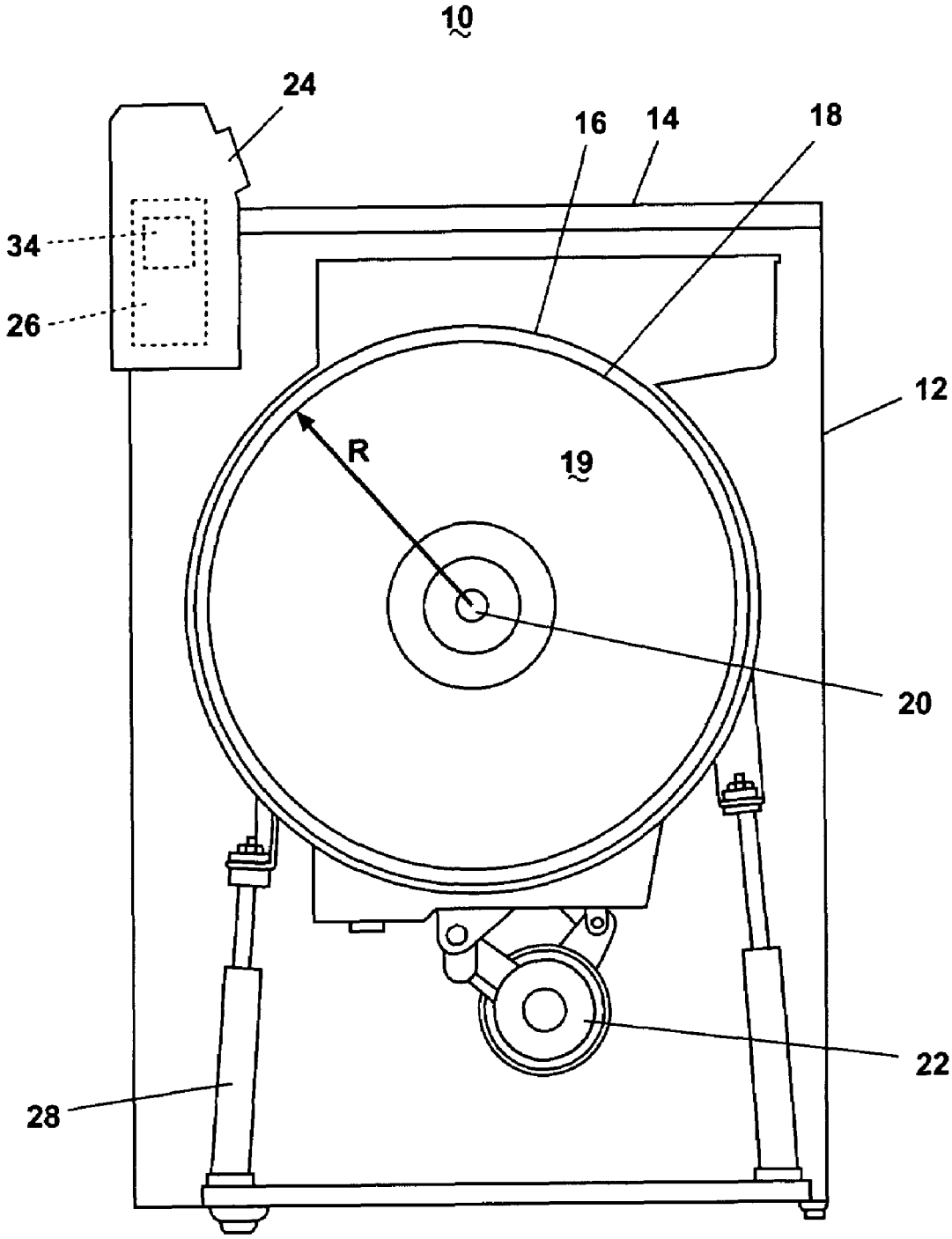
FIG. 1A is a schematic view of a horizontal axis washing machine that executes a method for controlling a spin cycle according to the invention.
Figure 1B:
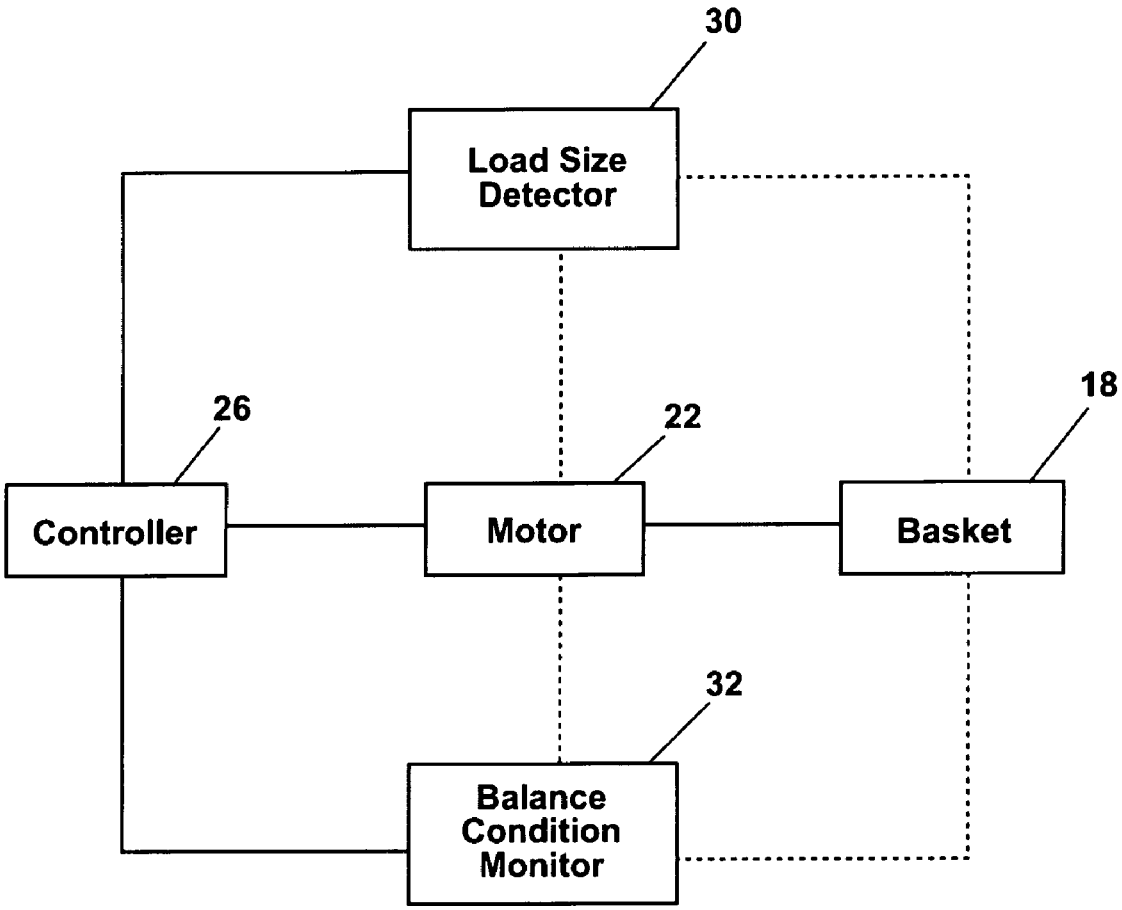
FIG. 1B is a schematic view of a control system for sensing the unbalanced condition of the washing machine.

Referring now to the figures and FIGS. 1A and 1B in particular, a horizontal axis washing machine 10 for executing a method for controlling a spin cycle according to the invention comprises a housing 12 with an open top closed by a lid 14. A perforated drum or basket 18 mounted within an imperforate drum 16 in the housing 12 rotates about a horizontal axis 20, as is well known in the washing machine art. The drum 18 defines a wash chamber 19 of radius R and sized to receive a load of fabric items, such as clothing, bedding, towels, and the like. Further, the drum 18 is mounted to the housing 12 through a suspension system 28 for damping relatively minor vibrations resulting from imbalance of the load in the drum 18. Rotation of the drum 18 is accomplished by a motor 22 operated by a controller 26. The controller 26 includes a timer 34 and is operatively coupled with a user interface 24 for receiving user inputs, such as characteristics of the load, such as fabric type and soil condition; desired cleaning cycle; and cleaning cycle initiation.

Referring particularly to FIG. 1B, the washing machine 10 further comprises a load size detector 30 and a balance condition monitor 32 operably coupled to the controller 26. The load size detector 30 can be any suitable device or system for estimating the size of the load in the drum 18 and is in operable communication with the drum 18 and/or the motor 22. For example, the load size detector 30 can be a sensor coupled to the drum 18 for detecting the volume of the load in the drum 18 or a parameter indicative of the volume of the load in the drum 18, or the load size detector 30 can be in communication with the motor 22 for processing an input or output of the motor 22, such as motor current or speed, that is indicative of the size of the load. Exemplary methods for determining load size are disclosed in U.S. Pat. Nos. 4,697,293; 5,130,624; and 6,393,872, which are incorporated herein by reference in their entirety.

There are several known methods, systems, and devices in the washing machine art for detecting the size of the load, and it is within the scope of the invention to utilize any method, system, and device. For purposes of the invention, the load size detector 30 can also be part of the user interface 24, whereby the user manually inputs the load size as estimated by the user through the user interface 24. Regardless of type, the load size detector 30 outputs a load size signal to the controller 26. The load size signal includes information related to the load size; the information can be the load size itself or data that can be processed by the controller 26 to calculate the load size. Further, the load size can be characterized by a numerical value corresponding to the volume of the load or by a qualitative descriptor, such as extra small, small, medium, large, and extra large.

Similarly, the balance condition monitor 32 can be any suitable device or system for detecting imbalance of the load in the drum 18 and is in operable communication with the drum 18 and/or the motor 22. There are several known methods, systems, and devices in the washing machine art for detecting imbalance in the load, and it is within the scope of the invention to utilize any method, system, and device. For example, the balance condition monitor 32 can comprise a sensor or multiple sensors positioned adjacent the drum 18 so that the drum 18 does not contact the sensor during normal, balanced rotation and contacts the sensor when drum 18 eccentrically rotates as a result of a sufficiently out of balance load in the drum 18. Such a sensor is disclosed in U.S. Pat. No. 3,674,419, which is incorporated herein by reference in its entirety. Other examples of balance condition monitors 32 include systems for monitoring an input or output of the motor 22, such as motor current or speed that is indicative of imbalance in the load. An exemplary method for detecting load unbalance in a washing machine is disclosed in U.S. Pat. No. 6,640,372, which is incorporated herein by reference in its entirety. Regardless of type, the balance condition monitor 32 outputs a balance condition signal to the controller 26. The balance condition signal includes information related to the balance condition of the load; the information can be the balance condition itself or data that can be processed by the controller 26 to determine the balance condition. The controller 26 determines that the load is imbalanced when the balance condition of the load is equal to or greater than a predetermined threshold or threshold value. The predetermined value is determined empirically and depends on several factors, including the size (the radius R) of the drum 18.

The washing machine 10 can run according to one of several automatic cleaning cycles preprogrammed into the controller 26. For example, the controller 26 can be preprogrammed with a cleaning cycle for each fabric type, and the cleaning cycle can be altered according to the soil condition, such as lightly or heavily soiled, of the load and the load size as determined by the load size detector 30. Each cleaning cycle comprises a wash cycle for tumbling the load in the drum 18 with liquid and wash aid, such as detergent, a rinse cycle to flush the load with liquid to rinse the wash aid from the load, and a spin cycle to extract excess rinse liquid from the load. The wash cycle and the rinse cycle can be any suitable wash cycle and rinse cycle and are not germane to the invention; therefore, the wash cycle and the rinse cycle will not be described in further detail. The spin cycle typically follows the rinse cycle.

Figure 2:
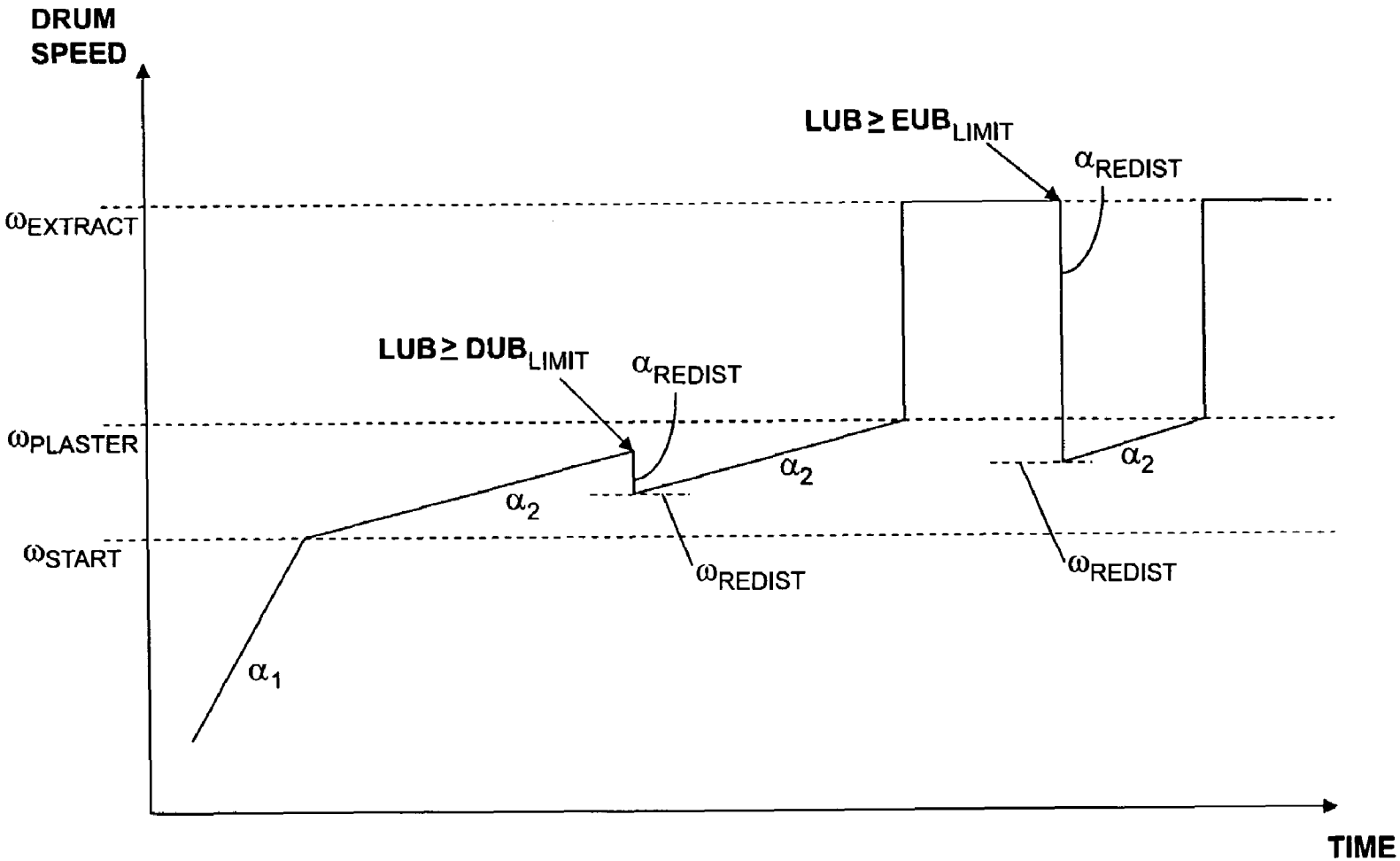
FIG. 2 is a graph depicting an exemplary spin cycle according to the invention.
Figure 3A:
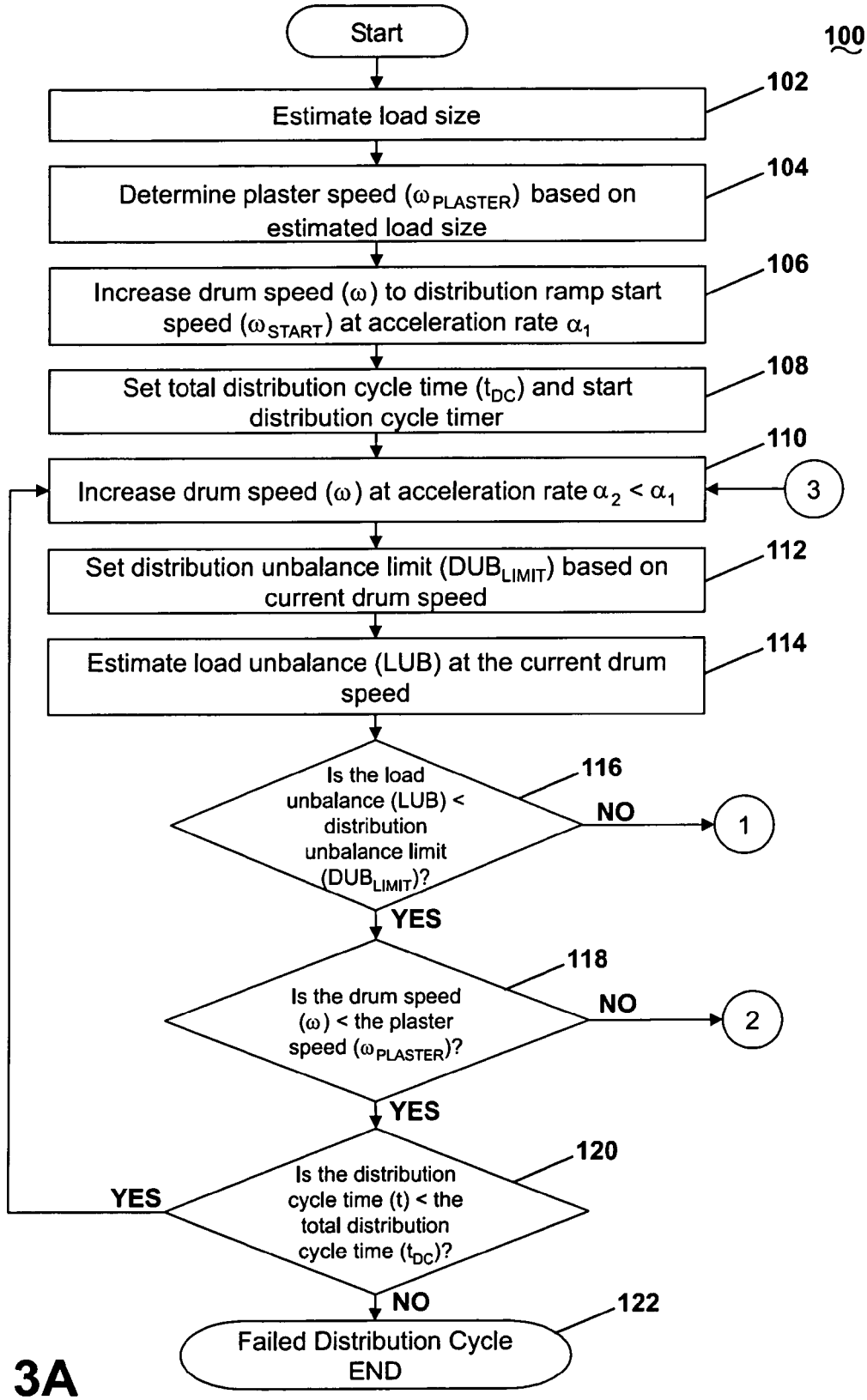
FIGS. 3A-3C is a flow chart of the method for controlling the spin cycle according to the invention.
Figure 3B:
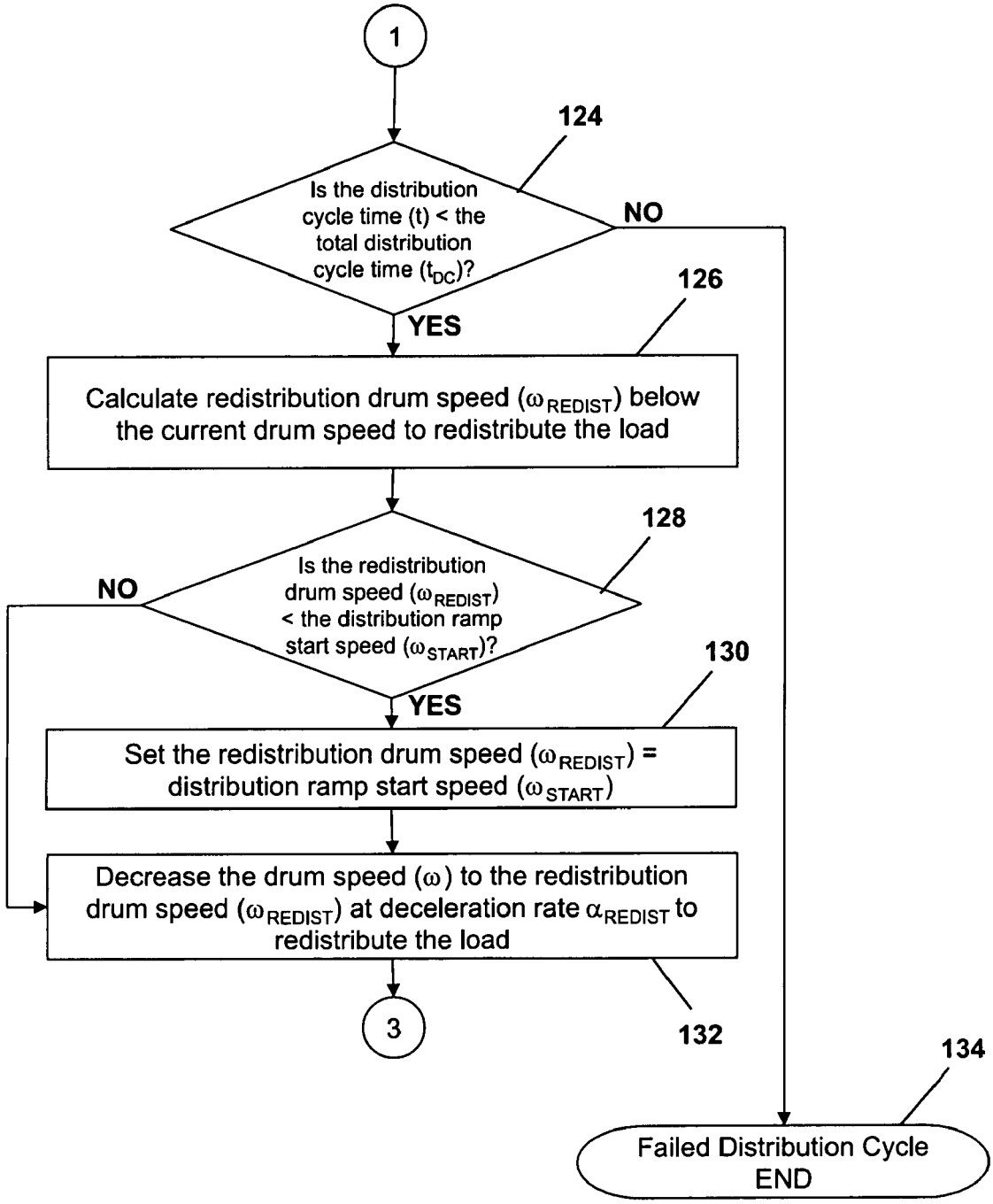
Figure 3C:
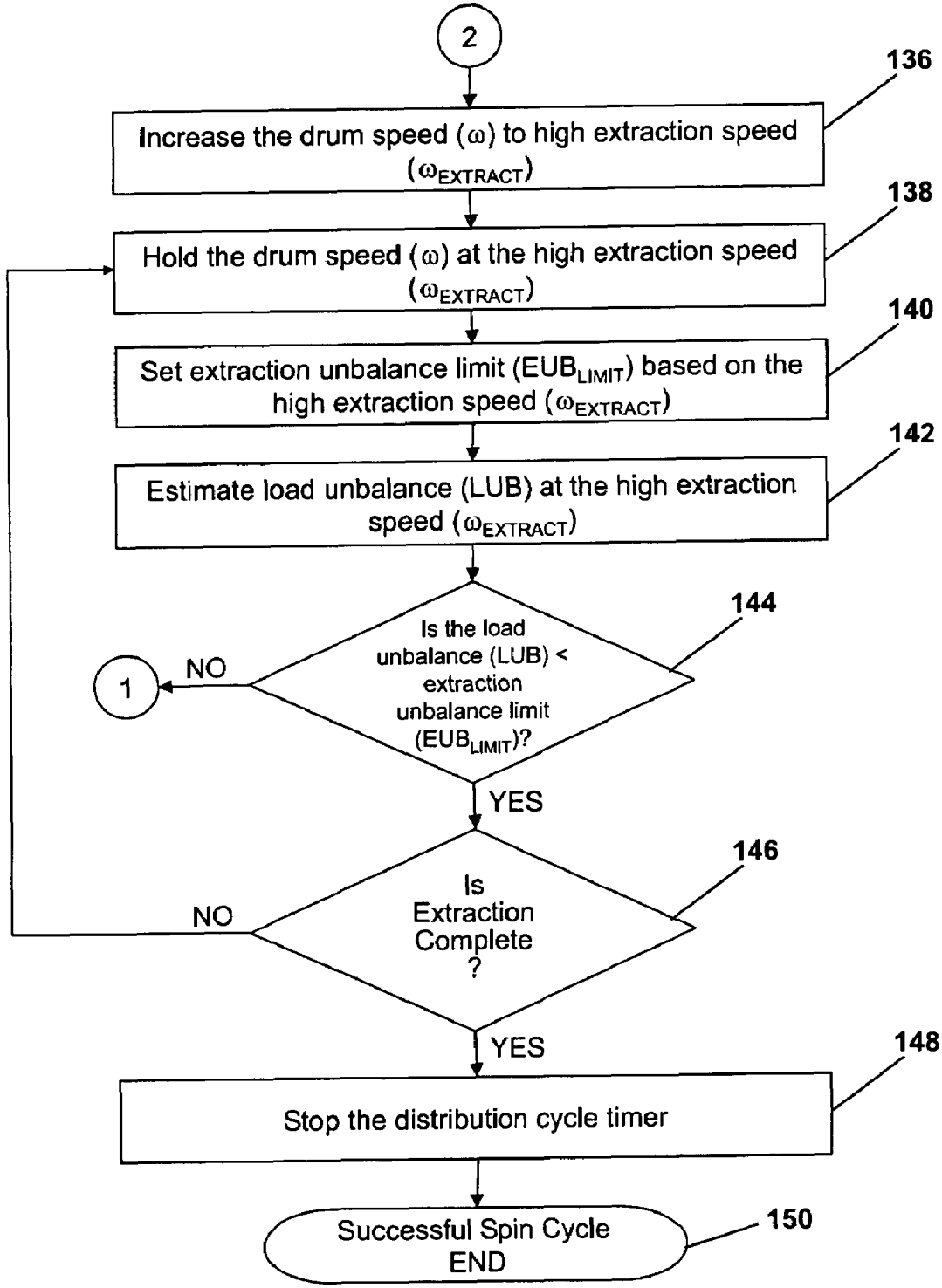

An exemplary spin cycle according to the invention is illustrated graphically in FIG. 2, and the steps for implementing an inventive method 100 for the spin cycle of FIG. 2 are depicted in the flowchart of FIGS. 3A-3C. Reference to FIGS. 2-3C should be made for the following description.

In step 102 of the method 100, the load size detector 30 estimates the size of the load in the drum 18. The estimation of the load size can be conducted at the beginning of the spin cycle, during another portion of the cleaning cycle, or before the cleaning cycle initiates. The load size detector 30 generates the load size signal and communicates the load size signal to the controller 26. After the load size is determined, the controller 26 utilizes the load size to determine a plaster speed ($\omega_{plaster}$) for the load in step 104. The load gradually becomes orbital or "plastered" against wall of the drum 18 as the rotational speed of the drum 18 increases. A fabric item becomes plastered when it rotates with the basket and does not tumble. Plastering normally occurs when the normal force of the fabric item is greater than about 1 G, and the plaster speed is the rotational speed at which all of the fabric items in the load experience a normal force of 1 G and become orbital or "plastered" against wall of the drum 18. For a given drum radius R, the plaster speed increases with increasing load size and is determined empirically. The plaster speeds can be stored in the controller 26 in the form of a look-up table or can be calculated using an equation, such as an empirical equation.

After the plaster speed is determined, the controller 26 instructs the motor 22 to increase rotational speed ($\omega$) of the drum 18 to a predetermined start speed ($\omega_{start}$) at a predetermined first acceleration ($\alpha_1$) in step 106. The start speed and the first acceleration can be preprogrammed into the controller 26 as default values, and, if desired, the default values can be changed by the user through the user interface 24. The start speed is the speed at which a slow, gradual ramp to the plaster speed initiates, as will be described in detail hereinafter.

Once the speed of the drum 18 reaches the start speed, the controller 26 in step 108 sets a total distribution cycle time ($t_{DC}$) and starts the timer 34 to monitor a distribution cycle time (t) of the spin cycle. In general, the distribution cycle comprises gradually increasing the speed of the drum 18 to the plaster speed at a second acceleration ($\alpha_2$) less than the first acceleration ($\alpha_1$) to evenly distribute the fabric items within the drum 18. As the drum 18 accelerates during the distribution cycle, the balance condition monitor 32 monitors the balance condition of the load to determine whether an imbalance develops in the load.

The distribution cycle begins at step 110 when the controller 26 instructs the motor 22 to increase the rotational speed of the drum 18 to the plaster speed at the second acceleration. As the speed of the drum 18 increases, the controller 26 either continuously or at intervals sets a distribution unbalance limit ($DUB_{limit}$) according to the current drum speed in step 112, and the balance condition monitor 32 estimates in step 114 the balance condition or load unbalance (LUB) at the current drum speed. The process of estimating the balance condition or load unbalance in step 114 includes the balance condition monitor 32 monitoring the balance condition of the load, generating the balance condition signal, and communicating the balance condition signal to the controller 26. Next, the controller 26 compares the load unbalance to the distribution unbalance limit in step 116 to determine whether the load is imbalanced. If the load is not imbalanced (i.e., the load unbalance is less than the distribution unbalance limit), then the controller 26 proceeds to step 118 and determines whether the speed of the drum 18 has reached the plaster speed. If the speed of the drum 18 is less than the plaster speed, then the controller 26 polls the timer 34 in step 120 to determine whether the distribution cycle time is less than the total distribution cycle time. If the distribution cycle time has not reached or exceeded the total distribution cycle time, then the controller 26 returns to step 110 to continue the relatively slow ramp of the drum speed to the plaster speed. The controller 26 cycles through this process until the drum speed reaches the plaster speed with the load unbalance below the distribution balance limit at step 116 or until the distribution cycle time reaches or exceeds the total distribution time in step 120. In the latter case, the distribution cycle fails and the controller 26 instructs the motor 22 to cease rotation of the drum 18 in step 122.

During the slow ramp of the drum 18 to the plaster speed, the drum speed increase is interrupted if the load unbalance is determined in step 116 to be equal to or greater than the distribution balance limit, thereby indicating that the load is imbalanced. Such an interruption occurs to redistribute the load and is illustrated graphically in FIG. 2. The steps of the method 100 related to the redistribution are shown in FIG. 3B. If the load is imbalanced and the distribution cycle time has reached the total distribution cycle time as determined in step 124, the distribution cycle terminates at step 134. If the distribution cycle time has not reached the total distribution cycle time, the controller 26 calculates or otherwise determines in step 126 a redistribution drum speed ($\omega_{redist}$) below the current drum speed. The controller 26 compares in step 128 the redistribution drum speed to the start speed and sets the redistribution drum speed equal to the start speed in step 130 if the redistribution drum speed is less than the start speed to ensure that the drum speed does not drop below the start speed. Next, in step 132, the controller 26 instructs the motor 22 to step the drum speed down to the redistribution drum speed. The drum speed is decreased rapidly at a redistribution deceleration $\alpha_{redist}$, whose magnitude is significantly greater than the first and second acceleration rates. The redistribution deceleration is illustrated schematically in FIG. 2 as instantaneous. Realistically, the redistribution deceleration cannot be instantaneous; however, the deceleration to the redistribution drum speed occurs as a step rather than a gradual change in speed, which occurs during the slow ramp of the drum speed to the plaster speed at the second acceleration rate.

Because the redistribution drum speed is below the speed at which the load imbalance is detected, the fabric item or fabric items that contributed to load unbalance reaching or exceeding the distribution unbalance limit fall out of orbit when the speed of the drum 18 is decreased to the redistribution drum speed. By reducing the drum speed to the redistribution drum speed rather than stopping the drum 18, as in some prior art washing machines 10, the imbalance in the load is efficiently removed without requiring interference from the user.

After the decrease to the redistribution drum speed, the method 100 returns to step 110 of the distribution cycle to continue the slow ramp to the plaster speed. The method continues to cycle through steps 110-120 and possibly steps 124-132 if the load becomes imbalanced until the drum speed reaches the plaster speed at step 118 (unless the distribution cycles fails at steps 122 and 134 as a result of the distribution cycle time reaching the total distribution cycle time). Once the rotational speed of the drum 18 reaches the plaster speed, all of the fabric items experience a normal force of 1 G and are, therefore, orbital or plastered to the wall of the drum 18. Because the plaster speed is a function of load size, the slow ramp to the plaster speed is optimized. For example, a relatively small load has a plaster speed less than that of a relatively large load, and, therefore, the distribution cycle of the spin cycle for the relatively small load can terminate at a lower speed. Depending on the number of redistribution occurrences during the slow ramp, the lower plaster speed can advantageously translate to a shorter and more efficient distribution cycle.

Once the rotational speed of the drum 18 reaches the plaster speed with the load balanced, the controller 26 instructs the motor 22 to step the speed of the drum 18 from the plaster speed to a relatively high extraction speed ($\omega_{extract}$) in step 136 and to hold the drum 18 at the extraction speed in step 138 to remove excess rinse liquid from the fabric items in the load. The steps of the method 100 related to the extraction are shown in FIG. 3C. While the drum 18 is rotated at the extraction speed, the controller 26, in step 140, either continuously or at intervals sets an extraction unbalance limit ($EUB_{limit}$) that corresponds to a threshold value for determining whether the load is imbalanced at the extraction speed. In step 142, the balance condition monitor 32 estimates the balance condition or load unbalance while the drum 18 rotates at the extraction speed. The process of estimating of the balance condition in step 142 includes the balance condition monitor 32 monitoring the balance condition of the load, generating the balance condition signal, and communicating the balance condition signal to the controller 26. Next, the controller 26 compares the load unbalance to the extraction unbalance limit in step 144 to determine whether the load is imbalanced.

If the load is balanced (i.e., the load unbalance is less than the extraction unbalance limit), then the controller 26 determines whether the extraction is complete in step 146. The completion of the extraction can be governed by a time/duration or by another parameter. If the extraction is not complete, the method returns to step 138 so that the drum 18 continues to rotate at the extraction speed. If the extraction is complete, then the controller 26 stops the distribution cycle time 34 at step 148 and terminates a successful spin cycle at step 150 by instructing the motor 22 to cease rotation of the drum 18.

If the load is determined to be imbalanced at step 144, then the method returns to step 124 to redistribute the load. In this case, the redistribution drum speed determined at step 126 is less than the plaster speed. The speed of the drum 18 must be reduced to below the plaster speed to bring at least a portion of the load out of orbit for redistribution. Such a redistribution after the extraction is shown schematically in the graph of FIG. 2. Once the speed of the drum 18 is reduced to below the plaster speed in step 132, the method 100 returns to step 110, where the controller 26 instructs the motor 22 to increase the rotational speed of the drum 18 to the plaster speed. The method continues through steps 110-120 and possibly steps 124-132 if the load becomes imbalanced until the speed of the drum 18 reaches the plaster speed with a balanced load. When the speed of the drum 18 reaches the plaster speed with the load in the balanced condition, the method 100 returns to step 136, where the controller 26 instructs the motor 22 to step the rotational speed of the drum 18 to the extraction speed for the extraction of the rinse liquid from the load. The method 100 then continues as described above to step 138 and so on.

The method 100 for controlling the spin cycle has been described with respect to the flow charts of FIGS. 3A-3C. It is within the scope of the invention, however, to execute the method 100 in a different sequence and to execute only portions of the method 100. Further, portions of the method 100 can be utilized with other methods for controlling spin cycles. For example, the distribution cycle of the spin cycle can be used with other types of extraction cycles. Additionally, the method 100 has been described for use with a horizontal axis, front loading washing machine, but it is within the scope of the invention to utilize the method with any type of horizontal axis washing machine regardless of where it is loaded, and, if suitable, a vertical axis washing machine.

The spin cycle and the method for controlling the spin cycle according to the invention efficiently distributes a balanced load in the drum 18, redistributes the load if the load becomes imbalanced, and extracts excess rinse liquid from the balanced load while continuing to monitor the balance condition of the load and remedying the imbalance if needed. The inventive method proactively distributes the load by monitoring load imbalance during the slow ramp and the extraction and taking action to correct the imbalance once it is detected. The rotational speed of the drum is decreased to a redistribution speed below its current speed and the plaster speed when the imbalance is detected to efficiently redistribute the fabric items in the load. Furthermore, because the plaster speed is a function of the load size, the slow ramp to the plaster speed is optimized for time and energy efficiency.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for spinning clothes in an automatic washing machine comprising a rotatable drum defining a wash chamber for receiving a fabric load to be cleaned, the method comprising:

determining the size of the fabric load;

determining a plaster speed based on the size of the fabric load;

gradually increasing the rotational speed of the drum to the plaster speed;

monitoring the balanced condition of the fabric load; and rapidly increasing the rotational speed of the drum from the plaster speed directly to an extraction speed if the fabric load is balanced.

2. The method of claim 1, and further comprising reducing the rotational speed of the drum to a redistribution speed in response to an unbalanced fabric load to effect a redistribution of the fabric load.

3. The method of claim 2, wherein the reducing the rotational speed of the drum comprises reducing the rotational speed of the drum from a speed less than or equal to the plaster speed to the redistribution speed.

4. The method of claim 3, and further comprising gradually increasing the rotational speed of the drum from the redistribution speed to the plaster speed after the reducing of the rotational speed to the redistribution speed.

5. The method of claim 4, and further comprising repeating the reducing of the rotational speed of the drum followed by the gradually increasing of the rotational speed of the drum to the plaster speed until the rotational speed of the drum reaches the plaster speed with the fabric load balanced.

6. The method of claim 5, and further comprising holding the rotational speed of the drum at the extraction speed.

7. The method of claim 6, and further comprising reducing the rotational speed of the drum from the extraction speed to a speed less than the plaster speed in response to an unbalanced fabric load to effect a redistribution of the fabric load.

8. The method of claim 7, and further comprising rapidly increasing the rotational speed of the drum again from the plaster speed to the extraction speed if the fabric load is balanced.

9. The method of claim 2, wherein the reducing the rotational speed of the drum comprises reducing the rotational speed of the drum from the extraction speed to the redistribution speed.

10. The method of claim 9, wherein the redistribution speed is less than the plaster speed.

11. The method of claim 10, and further comprising gradually increasing the rotational speed of the drum from the redistribution speed to the plaster speed.

12. The method of claim 11, and further comprising rapidly accelerating the rotational speed of the drum again from the plaster speed to the extraction speed if the fabric load is balanced.

13. The method of claim 1, wherein the monitoring of the balanced condition of the fabric load comprises monitoring the balanced condition while gradually increasing the rotational speed of the drum to the plaster speed.

14. The method of claim 1, wherein the monitoring of the balanced condition of the fabric load comprises monitoring the balanced condition of the fabric load at the extraction speed.

15. The method of claim 14, and further comprising holding the rotational speed of the drum at the extraction speed.

16. The method of claim 1, wherein the rapidly increasing the rotational speed of the drum comprises increasing from the plaster speed to an extraction speed in a single step.

17. A method for spinning clothes in an automatic washing machine comprising a rotatable drum defining a wash chamber for receiving a fabric load to be cleaned, the method comprising:

determining the size of the fabric load;

determining a plaster speed based on the size of the fabric load;

gradually increasing the rotational speed of the drum to the plaster speed;

monitoring the balanced condition of the fabric load; and rapidly increasing the rotational speed of the drum from the plaster speed to an extraction speed in a single step if the fabric load is balanced.

18. The method of claim 17, and further comprising reducing the rotational speed of the drum to a redistribution speed in response to an unbalanced fabric load to effect a redistribution of the fabric load.

19. The method of claim 18, wherein the reducing the rotational speed of the drum comprises reducing the rotational speed of the drum from a speed less than or equal to the plaster speed to the redistribution speed.

20. The method of claim 19, and further comprising gradually increasing the rotational speed of the drum from the redistribution speed to the plaster speed after the reducing of the rotational speed to the redistribution speed.

21. The method of claim 20, and further comprising repeating the reducing of the rotational speed of the drum followed by the gradually increasing of the rotational speed of the drum to the plaster speed until the rotational speed of the drum reaches the plaster speed with the fabric load balanced.

22. The method of claim 18, wherein the reducing the rotational speed of the drum comprises reducing the rotational speed of the drum from the extraction speed to the redistribution speed.

23. The method of claim 22, wherein the redistribution speed is less than the plaster speed.

24. The method of claim 17, wherein the monitoring of the balanced condition of the fabric load comprises monitoring the balanced condition while gradually increasing the rotational speed of the drum to the plaster speed.

25. The method of claim 17, wherein the monitoring of the balanced condition of the fabric load comprises monitoring the balanced condition of the fabric load at the extraction speed.

26. The method of claim 25, and further comprising holding the rotational speed of the drum at the extraction speed.

* * * * *